US010680303B2

(12) United States Patent
Meng et al.

(10) Patent No.: US 10,680,303 B2
(45) Date of Patent: Jun. 9, 2020

(54) COMBINER WITH A COMMON PORT AND A DUALLY LAYERED CAVITY

(71) Applicants: Comba Telecom Systems (China) Limited, Guangzhou, Guangdong (CN); Comba Telecom Technology (Guangzhou) Ltd., Guangzhou, Guangdong (CN); Comba Telecom Systems (Guangzhou) Ltd., Guangzhou, Guangdong (CN); Tianjin Comba Telecom Systems Ltd., Tianjin (CN)

(72) Inventors: Bihui Meng, Guangdong (CN); Zhenxiong Xie, Guangdong (CN); Guoming Zhou, Guangdong (CN); Jingqiang Wu, Guangdong (CN); Yunxi Jin, Guangdong (CN); Jinchao Xia, Guangdong (CN)

(73) Assignee: Comba Telecom Technology (Guangzhou) Limited (CN)

( * ) Notice: Subject to any disclaimer, the term of this patent is extended or adjusted under 35 U.S.C. 154(b) by 33 days.

(21) Appl. No.: 16/075,877

(22) PCT Filed: Apr. 20, 2017

(86) PCT No.: PCT/CN2017/081181
§ 371 (c)(1),
(2) Date: Aug. 6, 2018

(87) PCT Pub. No.: WO2017/206617
PCT Pub. Date: Dec. 7, 2017

(65) Prior Publication Data

US 2019/0044208 A1 Feb. 7, 2019

(30) Foreign Application Priority Data

Jun. 2, 2016 (CN) ..... 2016 1 0394046

(51) Int. Cl.
*H01P 1/213* (2006.01)
*H01P 5/16* (2006.01)
(Continued)

(52) U.S. Cl.
CPC ..... *H01P 1/213* (2013.01); *H01P 1/207* (2013.01); *H01P 1/2133* (2013.01); *H01P 5/12* (2013.01); *H01P 5/16* (2013.01)

(58) Field of Classification Search
None
See application file for complete search history.

(56) References Cited

U.S. PATENT DOCUMENTS

2010/0244982 A1* 9/2010 Di ..... H01P 1/2133 333/132
2010/0254366 A1 10/2010 Shu et al.
2011/0317714 A1* 12/2011 Arias ..... H01P 1/2136 370/464

FOREIGN PATENT DOCUMENTS

CN 201340896 Y 11/2009
CN 101478071 B 8/2013
(Continued)

OTHER PUBLICATIONS

International Search Report for Application No. PCT/CN2017/081181 dated Jul. 7, 2017.

*Primary Examiner* — Robert J Pascal
*Assistant Examiner* — Kimberly E Glenn
(74) *Attorney, Agent, or Firm* — Lerner, David, Littenberg, Krumholz & Mentlik, LLP

(57) ABSTRACT

A combiner with a common port and a dually layered cavity includes a cavity, a clapboard used for dividing the cavity into an upper cavity and a lower cavity, a common port, a number of signal posts, and a first coupling disc, said common port and said number of signal ports being disposed at two sides of the cavity respectively. The upper cavity and
(Continued)

the lower cavity are each provided with a number of filter paths, and an upper common harmonic post and a lower common harmonic post are disposed at a location close to the common port; a first coupling hole is defined in the clapboard at a location close to the common port, and the first coupling disc is disposed in the first coupling hole and connected with the common port.

5 Claims, 3 Drawing Sheets

(51) Int. Cl.
*H01P 1/207* (2006.01)
*H01P 5/12* (2006.01)

(56) References Cited

FOREIGN PATENT DOCUMENTS

| | | | |
|---|---|---|---|
| CN | 204130675 | U | 1/2015 |
| CN | 105846019 | A | 8/2016 |

* cited by examiner

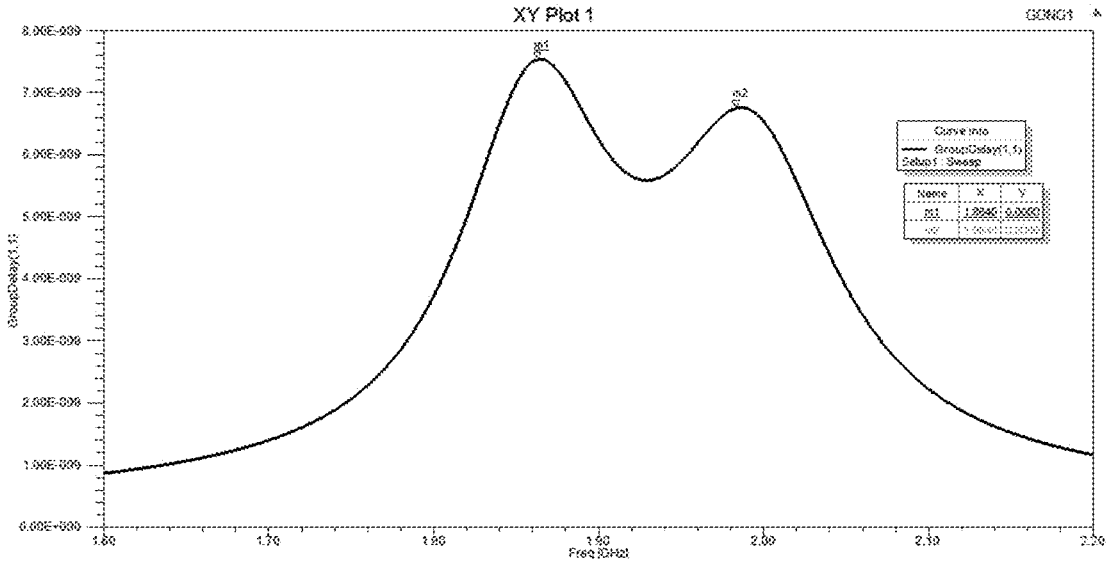

Fig. 5

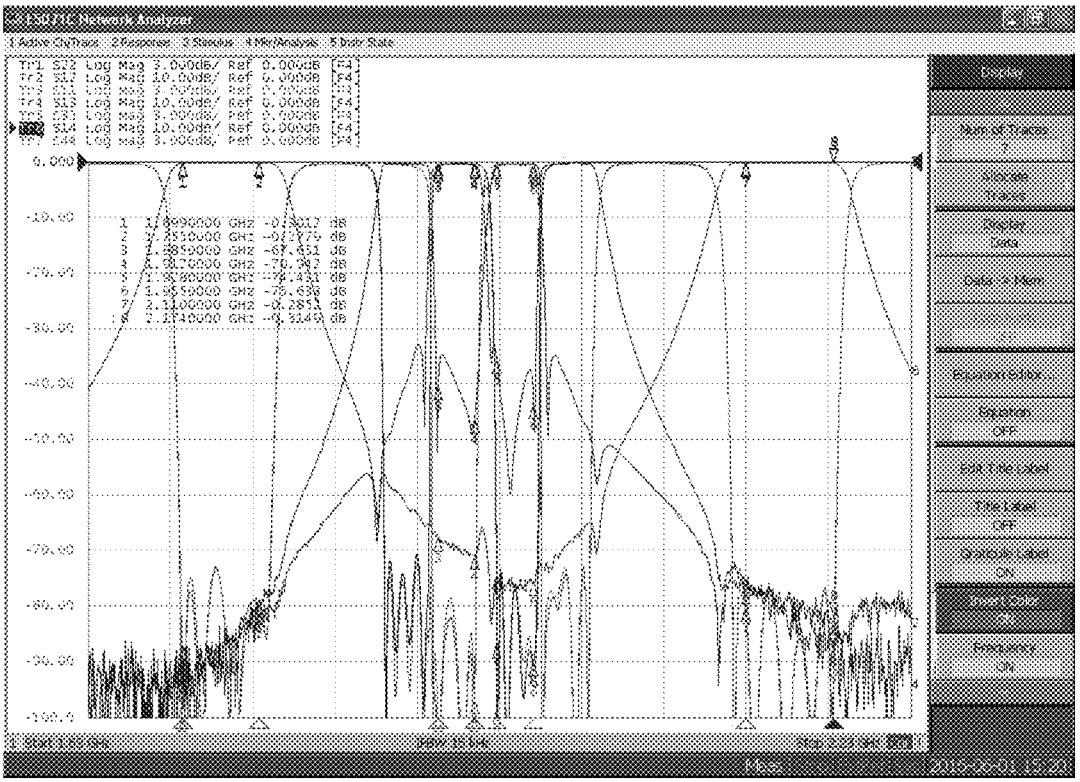
E5071C Network Analyzer
1 Active Ch/Trace 2 Response 3 Stimulus 4 Mkr/Analysis 5 Instr State
Tr1 S22 Log Mag 3.000dB/ Ref 0.000dB [F4]
Tr2 S11 Log Mag 10.00dB/ Ref 0.000dB [F4]
Tr3 S21 Log Mag 3.000dB/ Ref 0.000dB [F4]
Tr4 S12 Log Mag 10.00dB/ Ref 0.000dB [F4]
Tr5 S31 Log Mag 3.000dB/ Ref 0.000dB [F4]
Tr6 S14 Log Mag 10.00dB/ Ref 0.000dB [F4]
Tr7 S44 Log Mag 3.000dB/ Ref 0.000dB [F4]
6.000
-10.00
-20.00
-30.00
-40.00
-50.00
-60.00
-70.00
-80.00
-90.00
-100.0
1 1.7890000 GHz -0.3017 dB
2 1.8550000 GHz -0.1775 dB
3 1.8850000 GHz -67.651 dB
4 1.9170000 GHz -70.987 dB
5 1.9580000 GHz -76.431 dB
6 1.9950000 GHz -75.636 dB
7 2.1100000 GHz -0.2851 dB
8 2.1740000 GHz -0.5140 dB
Display
Num of Traces
Single Trace
Meas Data
Data → Mem
Smoothing
OFF
Sweep Type
Linear
Frequency
Span
Center
Start
Stop
Marker
Marker Table
Marker Search
Trace Info
Trace Math
Trace Statistics
Limit Test
Limit Line
Limit Line Table
Ripple Limit
Trace Function
Trace Memory
Trace Operation
Trace Setup
Trace Window
Trace Scale
Trace Average
Trace Hold
Trace Delay
Trace Length
Trace Velocity factor
Trace Impedance
Trace Port Extension
Trace Electrical Delay
Trace Phase Offset
Trace Port Z Conversion
Trace Port Z Conversion Impedance
Trace Port Z Conversion Reference Plane
Trace Port Z Conversion Method
Trace Port Z Conversion Mode
Trace Port Z Conversion Type
Trace Port Z Conversion Impedance Type
Trace Port Z Conversion Reference Plane Type
Trace Port Z Conversion Method Type
Trace Port Z Conversion Mode Type
Trace Port Z Conversion Type Type
Trace Port Z Conversion Impedance Type Type
Trace Port Z Conversion Reference Plane Type Type
Trace Port Z Conversion Method Type Type
Trace Port Z Conversion Mode Type Type
Trace Port Z Conversion Type Type Type
Trace Port Z Conversion Impedance Type Type Type
Trace Port Z Conversion Reference Plane Type Type Type
Trace Port Z Conversion Method Type Type Type
Trace Port Z Conversion Mode Type Type Type
Trace Port Z Conversion Type Type Type Type
Trace Port Z Conversion Impedance Type Type Type Type
Trace Port Z Conversion Reference Plane Type Type Type Type
Trace Port Z Conversion Method Type Type Type Type
Trace Port Z Conversion Mode Type Type Type Type
Trace Port Z Conversion Type Type Type Type Type
Trace Port Z Conversion Impedance Type Type Type Type Type
Trace Port Z Conversion Reference Plane Type Type Type Type Type
Trace Port Z Conversion Method Type Type Type Type Type
Trace Port Z Conversion Mode Type Type Type Type Type
Trace Port Z Conversion Type Type Type Type Type Type
Trace Port Z Conversion Impedance Type Type Type Type Type Type
Trace Port Z Conversion Reference Plane Type Type Type Type Type Type
Trace Port Z Conversion Method Type Type Type Type Type Type
Trace Port Z Conversion Mode Type Type Type Type Type Type
Trace Port Z Conversion Type Type Type Type Type Type Type
Trace Port Z Conversion Impedance Type Type Type Type Type Type Type
Trace Port Z Conversion Reference Plane Type Type Type Type Type Type Type
Trace Port Z Conversion Method Type Type Type Type Type Type Type
Trace Port Z Conversion Mode Type Type Type Type Type Type Type
Trace Port Z Conversion Type Type Type Type Type Type Type Type
Trace Port Z Conversion Impedance Type Type Type Type Type Type Type Type
Trace Port Z Conversion Reference Plane Type Type Type Type Type Type Type Type
Trace Port Z Conversion Method Type Type Type Type Type Type Type Type
Trace Port Z Conversion Mode Type Type Type Type Type Type Type Type
Trace Port Z Conversion Type Type Type Type Type Type Type Type Type
Trace Port Z Conversion Impedance Type Type Type Type Type Type Type Type Type
Trace Port Z Conversion Reference Plane Type Type Type Type Type Type Type Type Type
Trace Port Z Conversion Method Type Type Type Type Type Type Type Type Type
Trace Port Z Conversion Mode Type Type Type Type Type Type Type Type Type
Trace Port Z Conversion Type Type Type Type Type Type Type Type Type Type
Trace Port Z Conversion Impedance Type Type Type Type Type Type Type Type Type Type
Trace Port Z Conversion Reference Plane Type Type Type Type Type Type Type Type Type Type
Trace Port Z Conversion Method Type Type Type Type Type Type Type Type Type Type
Trace Port Z Conversion Mode Type Type Type Type Type Type Type Type Type Type
Trace Port Z Conversion Type Type Type Type Type Type Type Type Type Type Type
Trace Port Z Conversion Impedance Type Type Type Type Type Type Type Type Type Type Type
Trace Port Z Conversion Reference Plane Type Type Type Type Type Type Type Type Type Type Type
Trace Port Z Conversion Method Type Type Type Type Type Type Type Type Type Type Type
Trace Port Z Conversion Mode Type Type Type Type Type Type Type Type Type Type Type
Trace Port Z Conversion Type Type Type Type Type Type Type Type Type Type Type Type
Trace Port Z Conversion Impedance Type Type Type Type Type Type Type Type Type Type Type Type
Trace Port Z Conversion Reference Plane Type Type Type Type Type Type Type Type Type Type Type Type
Trace Port Z Conversion Method Type Type Type Type Type Type Type Type Type Type Type Type
Trace Port Z Conversion Mode Type Type Type Type Type Type Type Type Type Type Type Type
Trace Port Z Conversion Type Type Type Type Type Type Type Type Type Type Type Type Type
Trace Port Z Conversion Impedance Type Type Type Type Type Type Type Type Type Type Type Type Type
Trace Port Z Conversion Reference Plane Type Type Type Type Type Type Type Type Type Type Type Type Type
Trace Port Z Conversion Method Type Type Type Type Type Type Type Type Type Type Type Type Type
Trace Port Z Conversion Mode Type Type Type Type Type Type Type Type Type Type Type Type Type
Trace Port Z Conversion Type Type Type Type Type Type Type Type Type Type Type Type Type Type
Trace Port Z Conversion Impedance Type Type Type Type Type Type Type Type Type Type Type Type Type Type
Trace Port Z Conversion Reference Plane Type Type Type Type Type Type Type Type Type Type Type Type Type Type
Trace Port Z Conversion Method Type Type Type Type Type Type Type Type Type Type Type Type Type Type
Trace Port Z Conversion Mode Type Type Type Type Type Type Type Type Type Type Type Type Type Type
Trace Port Z Conversion Type Type Type Type Type Type Type Type Type Type Type Type Type Type Type
Trace Port Z Conversion Impedance Type Type Type Type Type Type Type Type Type Type Type Type Type Type Type
Trace Port Z Conversion Reference Plane Type Type Type Type Type Type Type Type Type Type Type Type Type Type Type
Trace Port Z Conversion Method Type Type Type Type Type Type Type Type Type Type Type Type Type Type Type
Trace Port Z Conversion Mode Type Type Type Type Type Type Type Type Type Type Type Type Type Type Type
Trace Port Z Conversion Type Type Type Type Type Type Type Type Type Type Type Type Type Type Type Type
Trace Port Z Conversion Impedance Type Type Type Type Type Type Type Type Type Type Type Type Type Type Type Type
Trace Port Z Conversion Reference Plane Type Type Type Type Type Type Type Type Type Type Type Type Type Type Type Type
Trace Port Z Conversion Method Type Type Type Type Type Type Type Type Type Type Type Type Type Type Type Type
Trace Port Z Conversion Mode Type Type Type Type Type Type Type Type Type Type Type Type Type Type Type Type
Trace Port Z Conversion Type Type Type Type Type Type Type Type Type Type Type Type Type Type Type Type Type
Trace Port Z Conversion Impedance Type Type Type Type Type Type Type Type Type Type Type Type Type Type Type Type Type
Trace Port Z Conversion Reference Plane Type Type Type Type Type Type Type Type Type Type Type Type Type Type Type Type Type
Trace Port Z Conversion Method Type Type Type Type Type Type Type Type Type Type Type Type Type Type Type Type Type
Trace Port Z Conversion Mode Type Type Type Type Type Type Type Type Type Type Type Type Type Type Type Type Type
Trace Port Z Conversion Type Type Type Type Type Type Type Type Type Type Type Type Type Type Type Type Type Type
Trace Port Z Conversion Impedance Type Type Type Type Type Type Type Type Type Type Type Type Type Type Type Type Type Type
Trace Port Z Conversion Reference Plane Type Type Type Type Type Type Type Type Type Type Type Type Type Type Type Type Type Type
Trace Port Z Conversion Method Type Type Type Type Type Type Type Type Type Type Type Type Type Type Type Type Type Type
Trace Port Z Conversion Mode Type Type Type Type Type Type Type Type Type Type Type Type Type Type Type Type Type Type
Trace Port Z Conversion Type Type Type Type Type Type Type Type Type Type Type Type Type Type Type Type Type Type Type
Trace Port Z Conversion Impedance Type Type Type Type Type Type Type Type Type Type Type Type Type Type Type Type Type Type Type
Trace Port Z Conversion Reference Plane Type Type Type Type Type Type Type Type Type Type Type Type Type Type Type Type Type Type Type
Trace Port Z Conversion Method Type Type Type Type Type Type Type Type Type Type Type Type Type Type Type Type Type Type Type
Trace Port Z Conversion Mode Type Type Type Type Type Type Type Type Type Type Type Type Type Type Type Type Type Type Type
Trace Port Z Conversion Type Type Type Type Type Type Type Type Type Type Type Type Type Type Type Type Type Type Type Type
Trace Port Z Conversion Impedance Type Type Type Type Type Type Type Type Type Type Type Type Type Type Type Type Type Type Type Type
Trace Port Z Conversion Reference Plane Type Type Type Type Type Type Type Type Type Type Type Type Type Type Type Type Type Type Type Type
Trace Port Z Conversion Method Type Type Type Type Type Type Type Type Type Type Type Type Type Type Type Type Type Type Type Type
Trace Port Z Conversion Mode Type Type Type Type Type Type Type Type Type Type Type Type Type Type Type Type Type Type Type Type
Trace Port Z Conversion Type Type Type Type Type Type Type Type Type Type Type Type Type Type Type Type Type Type Type Type Type
Trace Port Z Conversion Impedance Type Type Type Type Type Type Type Type Type Type Type Type Type Type Type Type Type Type Type Type Type
Trace Port Z Conversion Reference Plane Type Type Type Type Type Type Type Type Type Type Type Type Type Type Type Type Type Type Type Type Type
Trace Port Z Conversion Method Type Type Type Type Type Type Type Type Type Type Type Type Type Type Type Type Type Type Type Type Type
Trace Port Z Conversion Mode Type Type Type Type Type Type Type Type Type Type Type Type Type Type Type Type Type Type Type Type Type
Trace Port Z Conversion Type Type Type Type Type Type Type Type Type Type Type Type Type Type Type Type Type Type Type Type Type Type
Trace Port Z Conversion Impedance Type Type Type Type Type Type Type Type Type Type Type Type Type Type Type Type Type Type Type Type Type Type
Trace Port Z Conversion Reference Plane Type Type Type Type Type Type Type Type Type Type Type Type Type Type Type Type Type Type Type Type Type Type
Trace Port Z Conversion Method Type Type Type Type Type Type Type Type Type Type Type Type Type Type Type Type Type Type Type Type Type Type
Trace Port Z Conversion Mode Type Type Type Type Type Type Type Type Type Type Type Type Type Type Type Type Type Type Type Type Type Type
Trace Port Z Conversion Type Type Type Type Type Type Type Type Type Type Type Type Type Type Type Type Type Type Type Type Type Type Type
Trace Port Z Conversion Impedance Type Type Type Type Type Type Type Type Type Type Type Type Type Type Type Type Type Type Type Type Type Type Type
Trace Port Z Conversion Reference Plane Type Type Type Type Type Type Type Type Type Type Type Type Type Type Type Type Type Type Type Type Type Type Type
Trace Port Z Conversion Method Type Type Type Type Type Type Type Type Type Type Type Type Type Type Type Type Type Type Type Type Type Type Type
Trace Port Z Conversion Mode Type Type Type Type Type Type Type Type Type Type Type Type Type Type Type Type Type Type Type Type Type Type Type
Trace Port Z Conversion Type Type Type Type Type Type Type Type Type Type Type Type Type Type Type Type Type Type Type Type Type Type Type Type
Trace Port Z Conversion Impedance Type Type Type Type Type Type Type Type Type Type Type Type Type Type Type Type Type Type Type Type Type Type Type Type
Trace Port Z Conversion Reference Plane Type Type Type Type Type Type Type Type Type Type Type Type Type Type Type Type Type Type Type Type Type Type Type Type
Trace Port Z Conversion Method Type Type Type Type Type Type Type Type Type Type Type Type Type Type Type Type Type Type Type Type Type Type Type Type
Trace Port Z Conversion Mode Type Type Type Type Type Type Type Type Type Type Type Type Type Type Type Type Type Type Type Type Type Type Type Type
Trace Port Z Conversion Type Type Type Type Type Type Type Type Type Type Type Type Type Type Type Type Type Type Type Type Type Type Type Type Type
Trace Port Z Conversion Impedance Type Type Type Type Type Type Type Type Type Type Type Type Type Type Type Type Type Type Type Type Type Type Type Type Type
Trace Port Z Conversion Reference Plane Type Type Type Type Type Type Type Type Type Type Type Type Type Type Type Type Type Type Type Type Type Type Type Type Type
Trace Port Z Conversion Method Type Type Type Type Type Type Type Type Type Type Type Type Type Type Type Type Type Type Type Type Type Type Type Type Type
Trace Port Z Conversion Mode Type

COMBINER WITH A COMMON PORT AND A DUALLY LAYERED CAVITY

CROSS-REFERENCE TO RELATED APPLICATIONS

The present application is a national phase entry under 35 U.S.C § 371 of International Application No. PCT/CN2017/081181 filed Apr. 20, 2017, which claims priority from Chinese Application No. 201610394046.5 filed Jun. 2, 2016, all of which are hereby incorporated herein by reference.

FIELD OF THE INVENTION

The present invention generally relates to the field of the communication radio frequency cavity device. More particularly, the present invention relates to a combiner with a common port and a dually layered cavity.

BACKGROUND OF THE INVENTION

In current mobile communication techniques, the microwave filter device has already become an indispensable and important component. With the advantage of excellent electromagnetic shielding, compact structure, low pass-band signal loss, small size and high power capacity, the metallic cavity filter has been selected as the first choice of the mobile communication base station transmitting filter for a long time.

For a combiner featuring several pass-bands, the combiner is mostly constructed of a dually layered cavity. The combiner with a dually layered cavity includes a common port in the form of a joint by which an upper filter path and a lower filter path are connected with each other. In a traditional design, a joint is used to weld two wires on it; one of the wires is connected to a first harmonic cavity of the upper filter path, while the other wire is connected to a first harmonic cavity of the lower filter path so that the upper filter path and the lower filter path are coupled together. Alternatively, a common harmonic cavity may be disposed in a middle location between the upper filter path and the lower filter path to realize coupling of the upper filter path and the lower filter path together through a common cavity.

In the first coupling manner it is necessitated that two wires be welded together (one wire is welded to the upper harmonic cavity, while the other wire is welded to the lower harmonic cavity), resulting in time and labor consumption. In addition, nonlinear factors of the cavity are also increased inevitably due to increase of welding spots.

Using the common harmonic cavity results in addition of another harmonic cavity of the combiner and accordingly, it also results in an increase in insertion loss. The loss outweighs the gain. Moreover, a common cavity, which is located in a middle position between the upper cavity and the lower cavity, is utilized, leading to difficulty in manufacture and complicated coupling between the ports and difficult in tuning.

SUMMARY OF THE INVENTION

The object of the present invention is to provide a combiner featuring use of a disc for coupling and meeting requirement of port bandwidth of two filter paths of upper and lower cavities. The combiner may be conveniently manufactured and assembled, become more compact, and can be better applied for mobile communication system.

For realizing the aforementioned object, the present invention provides the following technical solution.

A combiner with a common port and a dually layered cavity includes a cavity, a clapboard used for dividing the cavity into an upper cavity and a lower cavity, a common port, a number of signal posts, and a first coupling disc, said common port and said number of signal ports being disposed at two sides of the cavity respectively. The upper cavity and the lower cavity are each provided with a number of filter paths, and an upper common harmonic post and a lower common harmonic post are disposed at a location close to the common port; a first coupling hole is defined in the clapboard at a location close to the common port, and the first coupling disc is disposed in the first coupling hole and connected with the common port.

Furthermore, the combiner with a common port and a dually layered cavity further includes a number of second coupling discs connected with the number of the signal ports respectively, and a plurality of second coupling holes are defined in the clapboard at the location close to the corresponding signal ports, and a corresponding second coupling disc is disposed inside a corresponding second coupling hole.

Preferably, the upper common harmonic post and the lower common harmonic post are displaced laterally by a certain distance with respect to an axis of a joint of the common port, or the upper common harmonic post and the lower common harmonic post are aligned with each other relative to the axis of the joint of the common port.

Preferably, the distance between the first coupling disc and the upper common harmonic post equals the distance between the first coupling disc and the lower common harmonic post, or the distance between the first coupling disc and the upper common harmonic post is greater than the distance between the first coupling disc and the lower common harmonic post, or the distance between the first coupling disc and the upper common harmonic post is less than the distance between the first coupling disc and the lower common harmonic post.

Preferably, the first coupling disc is capable of being moved upwardly or downwardly relative to the clapboard.

Compared with prior art, the technical solution of current invention can obtain the following advantages:

At first, a combiner with a common port and a dually layered cavity of the invention separates by a clapboard the cavity into an upper layer and a lower layer. A first coupling hole is defined in the clapboard at a location close to the common port, and inside the first coupling hole is a coupling disc which is electrically connected with the common port. The coupling disc functions to realize distribution of the port bandwidth between an upper filter path and a lower filter path. Here a joint and the coupling disc are assembled together directly without need of being welded onto a harmonic post of the cavity. Compared with the prior art combiner where the ports of the upper cavity and the lower cavity are connected by welding them using two wires, the combiner of the invention not only reduces difficulty in assembling, but also reduces the nonlinear factors of the cavity because there is not welding spot on the harmonic post.

Secondly, in the prior art combiner with a common port and a dually layered cavity, the upper cavity and the lower cavity share a same harmonic cavity, and the more the number of the harmonic cavities is, the high the insertion loss of the cavity will be. Moreover, utilization of an additional common harmonic cavity increases the size and the manufacture costs of the cavity. Comparatively, the combiner with a common port and a dually layered cavity of the invention can meet the required port bandwidth without using an additional common harmonic cavity. Compared with the prior art combiner with a common harmonic cavity, the combiner of the invention has the advantages of low insertion loss, small size and easy assembling.

Additional aspects and advantages of the present invention will be partially appreciated and become apparent from the descriptions below, or will be well learned from the practice of the present invention.

BRIEF DESCRIPTION OF THE DRAWINGS

The above and/or additional aspects and advantages of the present invention will become apparent and readily appreciated from the following description of embodiments taken with reference to the accompanying drawings, in which:

FIG. 5 illustrates a simulation diagram of a port delay (bandwidth) of the combiner with a common port and a dually layered cavity of the invention; and FIG. 6 illustrates a measured S parameter diagram of the combiner with a common port and a dually layered cavity of the invention.

DETAILED DESCRIPTION OF THE INVENTION

Figure 1:
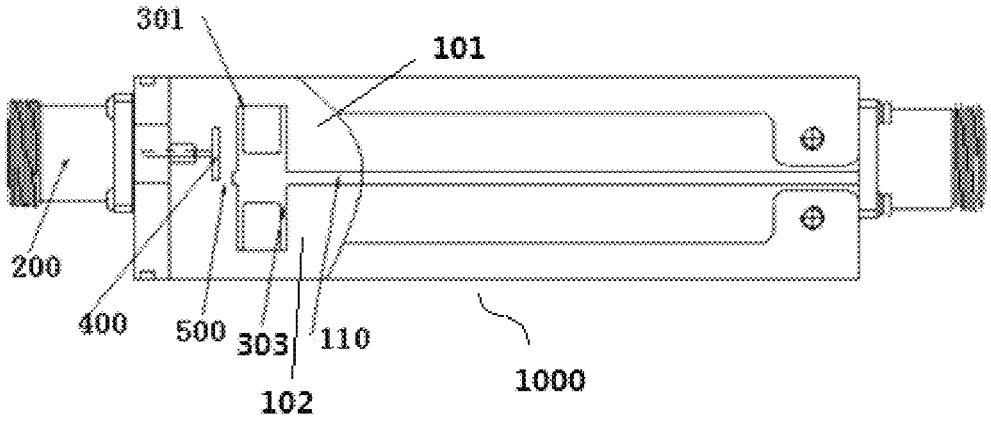
FIG. 1 illustrates a partial perspective view of a combiner with a common port and a dually layered cavity according to one embodiment of the invention.

Embodiments of the present invention will be described in detail hereinafter. The examples of these embodiments have been illustrated in the drawings throughout which same or similar reference numerals refer to same or similar elements or elements having same or similar functions. The embodiments described with reference to the drawings are illustrative, merely used for explaining the present invention and should not be regarded as any limitations thereto.

As showed in FIGS. 1-4, a combiner with a common port and a dually layered cavity 1000 of the invention (hereinafter referred as to "combiner"), incudes a cavity 100, a clapboard 110, a common port (including its joint) 200, a number of for example three signal ports (including their corresponding joints) 201, 202, 203, and a coupling disc.

The clapboard 110 divides the cavity 100 into an upper cavity 101 and a lower cavity 102, and the same clapboard 110 increases the structural strength of the combiner 1000, and is intended for separating signals between the upper cavity 101 and the lower cavity 102.

The upper cavity 101 and the lower cavity 102 each include three filter paths respectively (that is, the upper cavity and the lower cavity totally include six filter paths, and each filter path is provided with a plurality of harmonic posts 302, 304, 305, 306). Moreover, an upper common harmonic post 301 and a lower common harmonic post 303 are disposed at a location close to the common port 200 respectively. The joint of the common port 200 connected with the six filter paths and the joints 201, 202 and 203 correspondingly connected to the six signal ports are disposed at two lateral sides of the cavity 100 respectively. A first coupling hole 500 is defined in the clapboard 100 at a location close to the common port 200, and inside the first coupling hole 500 is a first coupling disc 400 which is connected with the common port 200.

A first signal travels through the first coupling disc 400 from the common port 200 and arrives at and couples with the upper common harmonic post 301 and the lower common harmonic post 303. Through the upper common harmonic post and the lower common harmonic post, the first signal then comes into respective filter paths for transmission, and finally it is output out of the three signal ports respectively. Therefore, bandwidth distribution at the common port 200 from the upper cavity 101 and the lower cavity 102 is achieved.

In the combiner 1000 of the invention, the cavity 100 is divided into the upper cavity and the lower cavity through the clapboard 110. The first coupling hole 500 is defined in the clapboard 110 at a location close to the common port 200, and inside the first coupling hole 500 is the first coupling disc 400 which is electrically connected with the common port 200. The first coupling disc 400 functions to realize distribution of the port bandwidth between the upper filter path and the lower filter path. Here, the joint of the common port is connected with the first coupling disc directly without need of being welded onto the harmonic post of the cavity. Compared with the prior art combiner where the ports of the upper cavity and the lower cavity are connected by welding them together using two wires, the combiner of invention not only reduces difficulty in assembling, but also reduces the nonlinear factors of the cavity because there is no welding spot on the harmonic post.

Moreover, a relatively small number of harmonic cavities is employed in the combiner of the invention due to omission of a common harmonic cavity in it. The combiner of the invention can reduce insertion loss, size of the cavity and cost.

Figure 2:
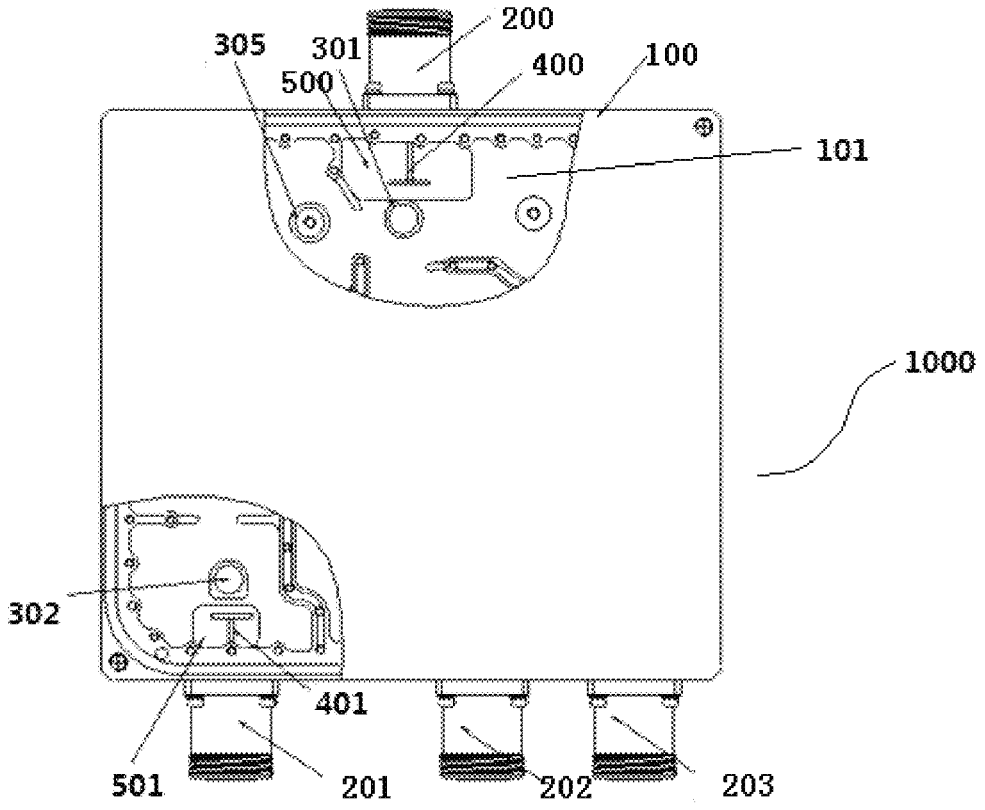
FIG. 2 illustrates another perspective view of the combiner with a common port and a dually layered cavity showed in the FIG. 1, viewed from another angle and showing the inner structure of an upper cavity.
Figure 3:
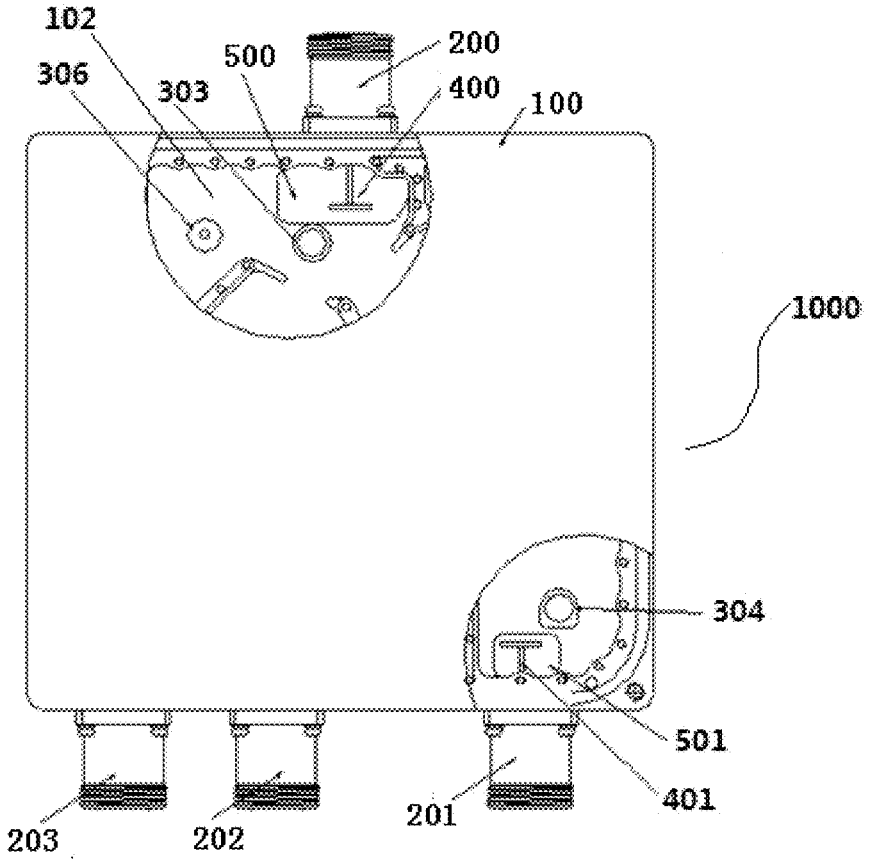
FIG. 3 illustrates another perspective view of the combiner with a common port and a dually layered cavity showed in the FIG. 1, viewed from another angle and showing the inner structure of the lower cavity.

Please refer to FIGS. 2-3. Furthermore, the clapboard 110 is provided with a plurality of second coupling holes 501 at locations close to the signal ports 201, 202 and 203 respectively, and each of the second coupling holes 501 is provided with a corresponding second coupling disc 401 therein, said second coupling disc 401 being connected with a corresponding signal port for realizing bandwidth distribution at the signal ports of the upper cavity and the lower cavity.

Signals F1, F2 and F3 from 3 different filter paths respectively are input from the joint of the three signal ports of 201, 202 and 203, pass through the corresponding second coupling discs 401 and then are divided into upper signals and lower signals (totally six kinds of signals F11, F12, F21, F22, F31 and F32, then these six kinds of signals are coupled together again at the first coupling disc 400, finally are combined together to form a signal F at the common port 200, and then the signal F is output from the joint of the same common port 200.

In the combiner of the invention, the clapboard 110 is provided with the coupling holes (including the first coupling hole 500 and the second coupling hole 501), and the coupling discs (including the first coupling discs 400 and the second coupling discs 401) connected with the ports are disposed between the common port 200 and the harmonic posts or between the signal ports 201, 202 and 203 and the harmonic posts. The radio frequency input through the common port is coupled by the first coupling disc, then is divided and distributed into various filter paths of the upper cavity and the lower cavity respectively; next, the divided frequency is further coupled together by the corresponding second coupling discs and finally is output from the respective signal port. Alternatively the radio frequency input through the signal port is coupled to corresponding filter paths, is further coupled together at the first coupling disc and finally is output from the common port.

Figure 4:
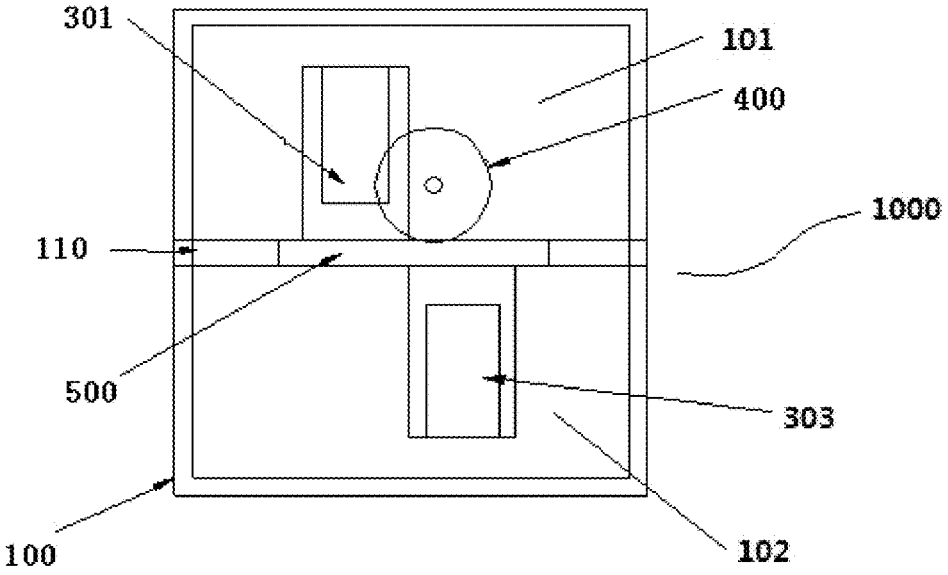
FIG. 4 illustrates a view showing distribution of an upper common harmonic post and a lower common harmonic post of the combiner with a common port and a dually layered cavity of the invention.

Referring to FIG. 4, as the electric field energy is generally concentrated onto the top of the harmonic posts 301~306, while the magnetic energy generally surrounds the harmonic posts 301~306, when the upper harmonic posts 301, 302 and 305 are correspondingly aligned erectly with the lower harmonic posts 303, 304 and 306, the range of the bandwidth distribution realized by the first coupling discs 400 and the second coupling discs 401 are small and therefore there is little practicality. Preferably, the upper common harmonic post 301 and the lower common harmonic post are displaced laterally by a certain distance with respect to an axis of the joint of the common port. Here, the required distance can be determined according to desired bandwidth distribution by person of ordinary skill in the art. As shown in the simulation diagram of FIG. 5, the band width of the upper filter path and the lower filter path can bring a bandwidth of 80 MHz respectively in case the upper harmonic post and the lower harmonic post at a location of the common port are displaced from each other.

Furthermore, the first coupling disc 400 can be moved downwardly or upwardly relative to the clapboard 110, so that the bandwidth distribution of the port of the upper filter path and the lower filter path can be adjusted. The bandwidth of the upper cavity is greater than that of the lower cavity when the first coupling disc 400 is located above the first coupling hole 500. The bandwidth of the lower cavity is greater than the bandwidth of the upper cavity when the first coupling disc 400 is located below the first coupling hole 500.

Therefore, by changing the distance between the first coupling disc 400 and the upper common harmonic post 301 or the distance between the first coupling disc 400 and the lower common harmonic post 303, that is, changing the height of the first coupling disc 400 in the cavity 100, bandwidth distribution of the signal in the upper cavity and the lower cavity is realized.

Specifically, the distance between the first coupling disc 400 and the upper common harmonic post 301 and the distance between the first coupling disc 400 and the lower common harmonic post 303 is equal, or the distance between the first coupling disc 400 and the upper common harmonic post 301 is greater than the distance between the first coupling disc 400 and the lower common harmonic post 303, or the distance between the first coupling disc 400 and the upper common harmonic post 301 is less than the distance between the first coupling disc 400 and the lower common harmonic post 303.

Furthermore, in case that the first coupling disc 400 is closer to the upper common harmonic post 301 (for example when the first coupling disc is above the first coupling hole), the bandwidth distribution of the port of the lower filter path can be adjusted by increasing or decreasing the size of the first coupling hole 500. Comparatively, when the first coupling disc 400 is closer to the lower common harmonic post 303, the bandwidth distribution of the port of the upper filter path can be adjusted by increasing or decreasing the size of the first coupling hole 500.

In other embodiments of the invention, when the upper harmonic posts 301, 302 and 305 and the lower harmonic posts 303, 304 and 306 are aligned up and down correspondingly, the bandwidth of the filter path of the upper cavity and the lower cavity can be distributed by increasing or decreasing the size of the coupling hole or moving upwardly or downwardly the coupling disc.

In summary, in the combiner of the invention, by adjusting the location of the first coupling disc and the common port relative to the first coupling hole (that is, the distance between the first coupling disc and the upper common harmonic post or between the first coupling disc and the lower common harmonic post), the size of the coupling hole and the distance between the upper common harmonic post and the lower common harmonic post, bandwidth distribution of the upper filter path and the lower filter path is achieved.

As shown in FIG. 6 which illustrates a measured S parameter diagram of the combiner of the invention. The S parameter curve shows that bandwidth of the upper filter path and the lower filter path at the joint of the common port 200 is approximately 250 MHz respectively, and the return losses of the S parameter curve are all below −20 MHz, and the isolation of frequency is below 30 dB, thus meeting the requirement of the small size, low insertion loss and high inhibition for the filter of modern mobile communication system.

The combiner of the invention can be widely used in the modern mobile communication system. Here, the range of the frequency of the three filter paths in the upper cavity is 1699 MHz-1912 MHz, and the range of the frequency of the three filter paths in the lower cavity is 1928 MHz-2174 MHz.

Though various embodiments of the present invention have been illustrated above, a person of the art will understand that, variations and improvements made upon the illustrative embodiments fall within the scope of the present invention, and the scope of the present invention is only limited by the accompanying claims and their equivalents.

The invention claimed is:

1. A combiner with a common port and a dually layered cavity, comprising a cavity, a clapboard used for dividing the cavity into an upper cavity and a lower cavity, the common port, a number of signal posts, and a first coupling disc, said common port and said number of signal posts being disposed at two sides of the cavity respectively, wherein the upper cavity and the lower cavity are each provided with a number of filter paths, and an upper common harmonic post and a lower common harmonic post are disposed at a location close to the common port;

a first coupling hole is defined in the clapboard at a location close to the common port, and the first coupling disc is disposed in the first coupling hole and connected with the common port.

2. The combiner with a common port and a dually layered cavity according to claim 1, further comprising a number of second coupling discs connected with the number of the signal posts respectively, and a plurality of second coupling holes are defined in the clapboard at locations close to the number of signal posts respectively, and ones of the number of the second coupling discs are disposed inside ones of the plurality of second coupling holes respectively.

3. The combiner with a common port and a dually layered cavity according to claim 1, wherein the upper common harmonic post and the lower common harmonic post are displaced laterally by a certain distance with respect to an axis of a joint of the common port, or the upper common harmonic post and the lower common harmonic post are aligned with each other relative to the axis of the joint of the common port.

4. The combiner with a common port and a dually layered cavity according to claim 1, wherein the distance between the first coupling disc and the upper common harmonic post equals the distance between the first coupling disc and the lower common harmonic post, or the distance between the first coupling disc and the upper common harmonic post is greater than the distance between the first coupling disc and the lower common harmonic post, or the distance between the first coupling disc and the upper common harmonic post is less than the distance between the first coupling disc and the lower common harmonic post.

5. The combiner with a common port and a dually layered cavity according to claim 1, wherein the first coupling disc is capable of being moved upwardly or downwardly relative to the clapboard.

* * * * *